United States Patent [19]

Maynes

[11] 4,280,291

[45] Jul. 28, 1981

[54] TWO-SIDED PORTABLE SCOREBOARD

[76] Inventor: Alan D. Maynes, 9619 S. 3100 East, Sandy, Utah 84070

[21] Appl. No.: 94,740

[22] Filed: Nov. 15, 1979

[51] Int. Cl.[3] ..... G09F 9/00

[52] U.S. Cl. ..... 40/495; 116/309

[58] Field of Search ..... 116/223, 318, 316, 224; 235/114, 113; 40/113, 493, 495

[56] References Cited

U.S. PATENT DOCUMENTS

| | | | |
|---|---|---|---|
| 855,827 | 6/1907 | Willson | 235/114 |
| 1,310,961 | 7/1919 | Osterberg | 235/113 |
| 1,725,976 | 8/1929 | Canode | 235/114 |
| 3,455,273 | 7/1969 | Willingham | 116/223 |

FOREIGN PATENT DOCUMENTS

| | | | |
|---|---|---|---|
| 344567 | 3/1931 | United Kingdom | 116/223 |

*Primary Examiner*—Gerald Goldberg
*Assistant Examiner*—Denis E. Corr
*Attorney, Agent, or Firm*—Thorpe, North, Western & Gold

[57] ABSTRACT

A two-sided portable scoreboard for simultaneously displaying a set of two-digit scores both frontally and rearwardly upon a single setting thereof. A pair of disks is sandwiched between a front and rear plate for each set of scores to be displayed. The disks are axially mounted so that a portion of each overlaps a portion of the other, their centers being positioned so that one is slightly more than a radial distance from the other. At least one of the disks has a transparent center section that has a diameter roughly equal to one-half the overall diameter of the disk. A set of scoring symbols are selectively positioned and uniformly spaced around the circumferential portion of both sides of each disk. Windows, or other viewing portions, are placed in both the front and rear plates so as to allow a desired sequence of scoring symbols to be viewed therethrough as the disks are rotated. The symbols placed on the rear side of the disks are phased with respect to those on the front side of the disks so that the same symbols simultaneously appear both frontally and rearwardly. The correct viewing sequence of the symbols is maintained frontally by having the symbol from a second disk, as read left to right from a front view, appear first in the symbol sequence by viewing the symbol through the transparent center section of the first disk.

12 Claims, 7 Drawing Figures

TWO-SIDED PORTABLE SCOREBOARD

BACKGROUND OF THE INVENTION

This invention relates to scoreboards and devices for displaying point totals, tallies, or other indicia associated with sporting events, games, contests, and the like, and in particular to a scoreboard which is portable and simultaneously displays the same score on both sides thereof in response to a single setting operation.

Scoring devices are used during sporting events, contests, games, and the like to remember and display the accumulated points or status of each individual or team.

One of the simplest forms of keeping score involves the use of a pencil and paper. Indeed, even the most sophisticated scoreboardsof this computerized era, still employ an "official scorekeeper" with a pencil and paper (or score pad) to keep track of a wide variety of information and events that transpire during the game or contest, only a fraction of which is ultimately displayed on the scoreboard. However, as the number of spectators increases, it becomes increasingly necessary for the scorekeeper to display the "score," and other selected indicia, associated with the game or contest, in large enough symbols for all to see. Hence, the scorekeeper supplements the use of the simple pencil and paper with a whole spectrum of scoreboard devices—from a simple chalk and chalkboard to the multi-million dollar, computerized, electronic scoreboards.

While the electronic and electric scoreboards of the past few decades have been very successful for the professional and quasi-professional competitive games and contests, such as the inter-school, collegiate, and professional levels, their overall cost and complexity have kept them beyond the reach of the non-professional, recreational type games and contests, such as those of the neighborhood, intra-school, church, and other similar groups. Moreover, games, contests, and the like of these recreational type groups typically take place in varied locations, from a vacant lot or park to a rented gym, thus making the use of the more complex, immovable, electically-dependent, scoreboards impractical.

An important factor associated with the use of any scoreboard is the ease with which the "official scorekeeper," or his designate, can set the scoreboard to display the desired score. In this respect, the electrical/electronic scoreboards are ideal because they are typically mounted in a highly visible location(s) and are easily controlled by the scorekeeper through the use of a readily accessible control panel. Unfortunately, however, such scoreboards are impractical for the non-professional, recreational type groups, for the reasons stated above—i.e., they are too expensive and are not readily moved from one location to another. Therefore, a critical need exists for a simple, low cost, mechanical, portable scoreboard that is easily and readily set by the scorekeeper to display the desired score, in large enough characters or symbols for all to see.

All prior art methods of displaying scores by a simple, low-cost, portable method with which this inventor is familiar, e.g., chalkboard, flip-charts, peg boards, and the like, suffer from at least one of three defects: (1) the "scorekeeper" does not have direct access to the actual display device, thereby necessitating the use of a third person who must operate the scoreboard at the scorekeepers direction; (2) the scorekeeper must sort through a collection of scoring symbols before finding the one(s) to be displayed, thereby creating undue delays and possibly diverting the scorekeeper's attention from the game or contest underway; or (3) the scorekeeper cannot conveniently position the scoreboard so that both he and the spectators can see it and the game or contest at the same time. Moreover, such prior-art systems typically display relatively small scoring symbols, thus making it difficult for spectator and performer alike to see the score thus displayed.

SUMMARY OF THE INVENTION

It is an object of the present invention to provide a low cost two-sided scoreboard that will serve the needs of low-budget, recreational groups, such as neighborhood, church intra-school and similar organizations.

It is another object of the present invention to provide such a two-sided scoreboard that is readily portable, and does not depend upon electrical power for its operation.

A further object of the present invention is to provide a two-sided scoreboard that allows a scorekeeper to easily set and verify a desired score thereon, without the need to move from his scorekeeper's position.

Still a further object of the present invention is to provide a scoreboard display that is readily visible and easily understood to a maximum number of spectators and participants.

Principal features of the invention include a pair of flat disks rotatably mounted between a front plate and a rear plate for each set of two-character score to be displayed. For example, a scoreboard that is to display a two-digit score for each of two teams utilizes two pairs of flat disks, or four disks altogether. Each disk has scoring symbols, such as numbers, selectively placed around the periphery of both sides therefore. A first disk of each pair has a transparent center section. This first disk is mounted closest to the front page, and the other disk, or second disk, is similarly mounted overlapping behind the first disk, so that its center is adjacent to the circumference of the first disk. A portion of the front plate between where the two centers of the disks are located is removed to create a "window" or viewing area through which two scoring symbols or characters are visible, one from each disk. The scoring symbol, from the second disk is frontally viewed through the transparent center section of the first disk and through the window of the front plate. The scoring symbol, from the first disk, is frontally viewed directly through the window of the front plate. Window or other viewing portions are also removed from the rear plate to expose one scoring symbol from each disk. However, these rear windows or viewing portions are located over the non-overlapping portions of the two disks, thereby allowing both scoring symbols to be directly viewed therethrough. When the scoring characters on the rear side of each disk are phased properly with equivalent scoring characters on the front side, the net result is that the same sequence of symbols, or score, is visible from both the front of the scoreboard and the rear of the scoreboard. A scorekeeper may easily modify this sequence of symbols by merely rotating one (or both) of the disks associated with each pair. Such rotation is facilitated by extending a portion of each disk beyond the front and rear plates, forming a tab, that can be grasped by the scorekeeper, thus allowing easily manual rotation of the disks.

The scoreboard as described above may be realized in almost any size. Preferably, it is large enough to mount right on the front of the scorekeeper's table, thereby allowing the scorekeeper to set it without moving from his chair. Large scoring characters may thus be displayed frontally, to both participants and spectators, while somewhat smaller scoring symbols may be displayed rearwardly to the scorekeeper.

BRIEF DESCRIPTION OF THE DRAWINGS

The above and other objects, features, and advantages of the invention will be more apparent from the following more particular description presented in connection with the accompanying drawings, in which.

DESCRIPTION OF THE PREFERRED EMBODIMENTS

Figure 1:
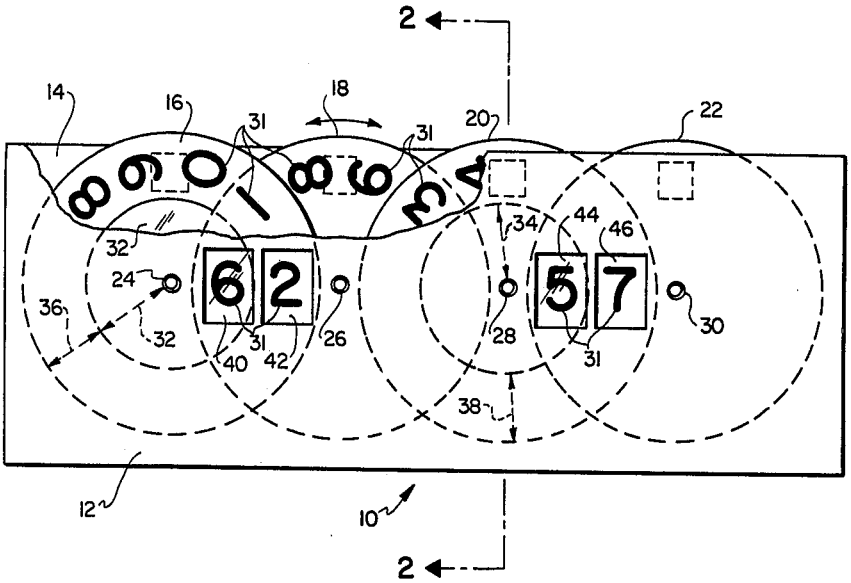
FIG. 1 is a front view of the two-sided portable scoreboard with a portion of the front plate cut-away.
Figure 2:
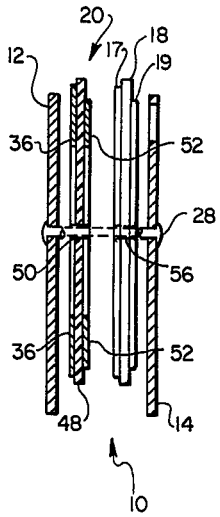
FIG. 2 is an expanded cross-sectional view taken along line 2—2 of FIG. 1.

Referring now to FIGS. 1 and 2, there is shown, respectively, a front and side cross-sectional view of a two-sided portable scoreboard 10. Four flat wheels, or "disks," 16, 18, 20, and 22, are sandwiched between an opaque front plate 12 and an opaque rear plate 14. These disks are axially mounted at their centers, so that they may each indepdently rotate in either direction, as illustratively shown by the arrow A-A in connection with disk 18. Rivots, pins, or bolts, with appropriate washers and nuts, may be used to axially mount each disk. In the drawings rivots are shown. Rivot 24 is used to axially mount disk 16; rivot 26 is used to axially mount disk 18; rivot 28 is used to axially mount disk 20; and rivot 30 is used to axially mount disk 22.

These same rivots 24, 26, 28, and 30 are also used to secure the front plate 12 to the rear plate 14, although additional structure, such as narrow side walls or additional rivots or bolts and nuts could also be used for this purpose if desired. It is important that the front and rear plates be held together by the rivots 24, 26, 28, and 30 (and additional structure, is used) under an appropriate tension so that the disks may be rotated by exterting a minimal tangential force at the circumference of each disk. However, it is also important that this tension be sufficient to cause the pressure of the front and rear plate to hold the disks in a given position once set there.

Each disk has a set of scoring symbols or characters 31 uniformly spaced around an outer portion thereof. In the preferred embodimdent, the arabic numerals or digits 0 through 9 are used, although any symbols or characters could be employed.

The disk 16 and the disk 20 are fabricated so as to have a transparent center portion, 32 and 34 respectively, surrounded by an opaque outer-ring portion, 36 and 38. For purposes of this application, transparent refers to any material through which visible light may readily pass, such as clear window glass, plexiglass, or other clear plastic. Transparent may also refer to the absence of any material.

The disks are axially mounted so that considerable overlap exists between them. That is, disks 16 and 20, having the transparent center portions 32 and 34, are mounted adjacent to the front plate 12. Disks 18 and 22, on the other hand, are mounted adjacent to the rear plate 14. The center of disk 18 is positioned close to the circumferential edge of disk 16 (or alternatively, the center of disk 16 is positioned close to the circumferential edge of disk 18). Similarly, disks 20 and 22 are positioned so that the center of one is close to the circumferential edge of the other.

A window or viewing portion 42 is removed from the front plate 12 so that one of the scoring symbols or characters 31 on disk 16, the character "2" in the drawings, may be viewed therethrough. Similarly, another window or viewing portion 40 is removed from the front plate 12 so that a scoring symbol or character 31 on disk 18, the character "6" in the drawings, may be viewed therethrough. Note that the character from disk 18 is visible through the window 40 only because of the transparent center portion 32 of disk 16. In a similar fashion, any of the characters on disk 22 may be made visible through a window 44 and the transparent center portion 34 of disk 20. In the Figures, the digit "5" is illustratively shown as being so visible. Likewise, any of the characters on disk 20 may be made visible through a window 46. The digit "7" is illustratively shown in the figures as being so visible.

As is apparent from the above description, disks 16 and 18 operate together as a single pair of disks that allows a two-character or two-digit score to be displayed. Similarly, disks 20 and 22 operate as a single pair of disks that allows a different two-digit score to be displayed. Although only two pairs of disks are shown in the preferred embodiment, (because only two teams are usually competing at a given time, thus requiring only two scores to be displayed) the invention herein disclosed contemplates that any number of pairs of disks could be employed if desired.

The expanded cross-sectional view of FIG. 2 teaches the preferred manner of fabricating the disks. FIG. 2 shows only disks 18 and 20, but disk 16 is identical to disk 20, and disk 22 is identical to disk 18. The front disk 20 (and also disk 16) is made from a solid disk of transparent glass or plastic 48 with a hole 50 in the center thereof through which the shaft of rivot 28 may pass. A thin opaque outer-ring portion 36 is affixed to the solid transparent disk 48. This opaque ring 38 may be made of any suitable opaqueing material, such as paper, plastic or even paint. The purpose of the opaque ring 38 is to provide a suitable background for the symbols or characters 31 that are uniformly spaced around the periphery of the disk. Hence, a contrasting color is preferred for the ring 36 as compared to the digits or characters 31. Thus, if black numbers are used for the scoring symbols 31, the opaque ring 36 should be a light color, such as white.

Figure 3:
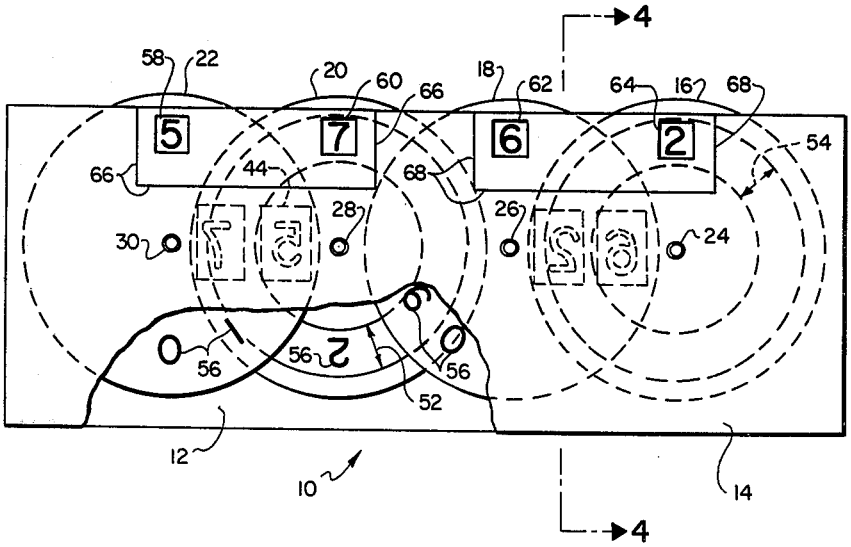
FIG. 3 is a back view of the scoreboard with a portion of the back plate cut-away.

The scoring symbols or characters 31 may be applied to the opaque ring 38 by any of numerous methods. They may be painted or silk-screened; or they may be commercially available decals or press-on characters. A protective coating of laquer, epoxy, or the like, may also be placed over the numbers to keep them from rubbing off as the disks are rotated. In addition to the opaque ring 38 placed on the front side of disk 20 (and the opaque ring 36 placed on the front side of disk 16), a similar opaque ring 52 may be placed on the rear side of disk 20, (and a corresponding opaque ring 54 may be placed on the rear side of disk 16). These rear opaque rings 52 and 54 are best illustrated in FIG. 3, but are also visible in the cross sectional views of FIGS. 2 and 4. These rear opaque rings, as will be explained below, save to highlight the scoring symbols or characters that are placed as the rear side of the disks.

The disks 18 and 22 need not have a transparent center portion as do disks 16 and 20, (although they could have one if it is desired to manufacture all disks alike.) Accordingly, any suitable material may be used for disks 18 and 22, such as heavy pasteboard, wood, metal, plastic, and similar materials. As seen in FIG. 2, a hole 56 is placed in the center of disk 18 through which the shaft of rivot 28 may pass. A similar hole is placed in the center of disk 18 through which the shaft of rivot 26 may pass. Opaque rings 17 and 19 may be placed on the front and rear sides respectively. Scoring symbols or characters 31, preferably of the same size and style as the scoring symbols or characters placed on disks 16 and 20, are applied to the rings 17 and 19 (or directly to the disks 18 and 22 if no rings 17 and 19 are used) so as to appear uniformly spaced around the front periphery of disks 18 and 22.

Referring now to FIG. 3, there is shown a back view of the scoreboard 10 with a portion of the back plate 14 cut away. A somewhat smaller set of scoring symbols or characters 56 is placed around the periphery of the rear side of each of the disks 16, 18, 20, and 22. As with the front scoring symbols or characters 31, a set of these rear characters 56 consist of the arabic numerals or digits 0 through 9 uniformly spaced around the periphery of each disk. A back window or viewing port 58 is placed in the rear plate 14 to allow one of the rear characters on disk 22 to be viewed therethrough. In FIG. 3, the character thus viewed is illustratively shown as the digit "5." The placing of this particular rear digit "5" is phased with respect to the placing of a corresponding front digit "5" so that at the same time the digit "5" is rearwardly viewed through the rear window 58, the digit "5" is also frontally viewed through the front window 44. All ten digits belonging to the set 0 through 9 on the rear side of each disk are thus phased with respect to their corresponding digits on the front side of each disk. With the rear and front digits phased in this fashion, rear windows or viewing points 60, 62, and 64 serve the same function with respect to front windows 46, 40, and 42 respectively as rear window 58 serves with respect to front window 44. Hence, the digit rearwardly viewed is always the same digit that is frontally viewed for a given disk. Note also that lines 66 and 68 may be painted, or otherwise affixed, to the rear plate 14 so as to group the rear window in pairs that correspond to a single two-digit score.

An important aspect of the invention herein disclosed is the placing of each pair of disks 16 and 18, and 20 and 22, so as to overlap each other. This overlap allows the digits to be both frontally and rearwardly viewed in the proper sequence. To illustrate, in FIG. 3 it is seen that the character "5" on disk 22 is the first digit of the rearwardly viewed score "57," while the character "7" on disk 20 is the second digit. From a front view, however, disk 20 is positioned before (to the left of) disk 22, which would cause the frontally viewed score to be "75" if the individual digits were displayed in the same order as their respective disks are placed. But because of the overlap, coupled with the transparent center portion of disk 20, the digits as frontally viewed are transposed so that the "5" of disk 22 appears to the left of the "7" of disk 20, even though disk 20 is positioned to the left of disk 22. Thus, in summary, the overlap of the front and rear disks, coupled with the transparent center portion of the front disk, cause the same viewing sequence of the digits to appear frontally as appears rearwardly.

Figure 4:
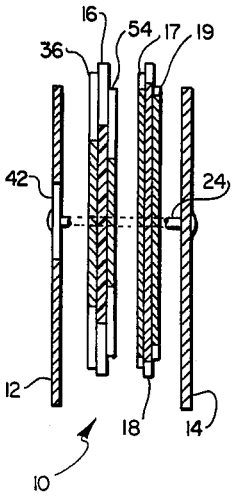
FIG. 4 is an expanded cross-sectional view taken along line 4—4 of FIG. 3.

FIG. 4 shows the cross-sectional relationship of disk 16 and 18 taken along the line 4—4 in FIG. 3. The window 42 of front plate 12 is particularly apparent in FIG. 4 inasmuch as line 4—4 intersects this window. Also apparent in FIG. 4 is the front opaque ring 36 which is attached to the front side of the transparent disk 16, and the rear opaque ring 54 which is attached to the rear side of this same disk. Because of the location of the cross-sectional line 4—4, these opaque rings, as well as the transparent disk 16 are only partially cut by the cross section line. FIG. 4 also shows the rear disk 18 as it appears along this same cross-section line.

Another important feature of the invention is the positioning of the disks 16, 18, 20, and 22 relative to the front and rear plates 12 and 14. In the preferred embodiment herein disclosed, which preferred embodiment is adapted for a simple, portable, nonelectrical, use, it is essential that each disk protrude beyond the front and rear plates a sufficient distance to allow a manual tangential force to be exerted that can rotate the disk. It would be possible of course, in more sophisticated embodiments of the invention, to include drive means, such as an electrical stepping motor, that would rotate each disk upon a proper command. The front disk could even be geared to the rear disk so that ten rotations of the front disk caused one rotation of the rear disk. However, these features would detract from the simplicity of the device, and therefore they are not included in the best mode herein disclosed for carrying out the invention.

Figure 5:
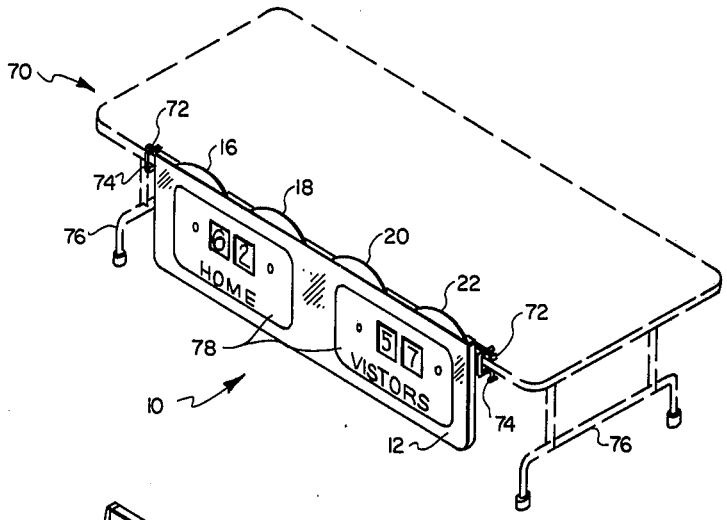
FIG. 5 is a perspective view of the scoreboard mounted on a scorekeeper's table.

A method of using the scoreboard 10 is shown in the perspective view of FIG. 5. The scoreboard 10 is clamped to the front edge of a table 70. When this method is used, a board 72 may be attached lengthwise to the back plate 14. This board may be clamped to the table top of table 70 using conventional C-clamps 74. The table 70 may have folding legs 76, thereby enabling the whole score-keeper's table assembly, including the scoreboard 10 and the table 70 to be highly mobile. Appropriate markings 78 may be painted, or otherwise affixed, to the front of the scoreboard 10 to group and designate which score corresponds to which team. In use, a score-keeper could sit behind the table 70, and easily reach the disks 16, 18, 20, and 22 in order to change the score that is displayed, which score is displayed frontally to participants and spectators and is, at the same time, displayed rearwardly to the score-keeper.

Figure 6:
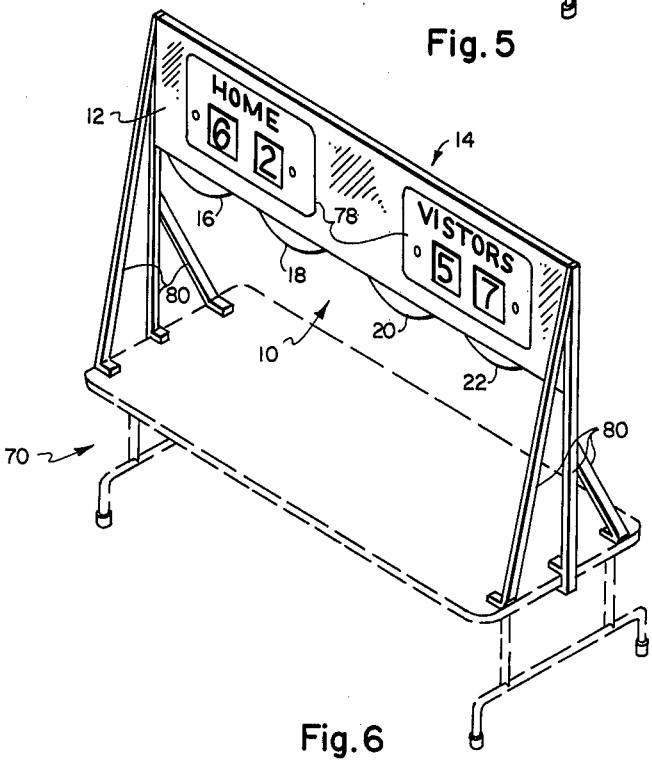
FIG. 6 is a perspective view of an alternative embodiment of the scoreboard mounted above a scorekeeper's table.

An alternative embodiment of the scoreboard 10 is shown generally in FIG. 6. This embodiment is used where it is desired to make the score as displayed from the rear of the unit highly visible to more than just those who sit at the scorer's table. In this embodiment, suitable support structure 80, is used to hold the scoreboard 10 above the score-keeper's table 70. This support structure is securely clamped to the table 70 so that the scoreboard 10 is rigidly held in a vertical plane. Any suitable rigid material could be used for the structure 80, such as wood or metal. Alternatively, the scoreboard 10 could merely be hung from ceiling support so that it was equivalantly positioned above the scorekeeper's table.

Figure 7:
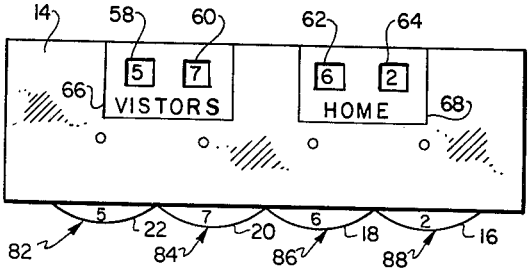
FIG. 7 is a back view of the alternative embodiment of FIG. 6 showing the use of additional score-keeping symbols as an aid to the scorekeeper.

For the embodiment shown in FIG. 6, it is necessary that the disks 16, 18, 20 and 22 be positioned relative to the front and rear plates 12 and 14 so that they protrude downwards, within easy reach of the scorekeeper. Moreover, additional scoring symbols may be selectively placed and phased on the back side of the protruding portions of these disks as shown at 82, 84, 86 and 88 of FIG. 7. These additional scoring symbols provide an aid to the scorekeeper in setting a desired score, making it unnecessary for him to lean back and/or look up at the higher displayed digits visible through windows 58, 60, 62, and 64.

While the invention herein disclosed has been described by means of specific embodiments and application thereof, numerous modifications and variations could be made thereto by those skilled in the art without departing from the spirit and scope of the present invention. It is therefore to be understood that within the scope of the appended claims, the invention may be practiced otherwise than as specifically described herein.

What is claimed is:

1. A two-sided scoreboard comprising:

a front plate;

a rear plate coupled to said front plate;

at least two pairs of disks axially mounted at their centers between said front and rear plates, each pair of said disks having a set of scoring symbols selectively placed around the front and rear periphery of each disk, the front sets of said scoring symbols being of a uniform size that is sufficiently large so as to be legibly visible to a person having normal vision who is positioned at least 30 feet away from the front side of said scoreboard, each of said pairs of disks comprising:

a front disk having a radius r of at least five inches, including a transparent center section having a radius approximately equal to r/2, positioned adjacent to said front plate, and a rear disk having a radius approximately equal to r, positioned adjacent to said rear plate and partially overlapping said front disk such that the center of said second disk is close to the circumferential edge of said front disk;

respective front windows in said front plate for each of said pairs of disks through which a pair of desired scoring symbols may be viewed in a desired sequence, a first symbol in either front window sequence belonging to the front set of scoring symbols placed around the respective rear disk and being viewed through said transparent center section of the respective front disk and through the respective window, and a second symbol in this front window sequence belonging to the front set of scoring symbols placed around said respective front disk and being viewed directly through said respective window, the spacing between said first and second symbols as viewed through said window being no more than the average width of the symbols belonging to said front set of symbols; and respective pairs of spaced apart rear windows in said rear plate through each pair of which an equivalent pair of desired scoring symbols may be viewed in the proper sequence and orientation as is viewed through the corresponding front windows, a first symbol in this rear window sequence belonging to the rear set of scoring symbols placed around the respective rear disk and being viewed from the rear side of said scoreboard directly through a left rear window of said respective pair, and a second symbol in this rear window sequence belonging to the rear set of scoring symbols placed around the respective front disk and being viewed from the rear side of said scoreboard directly through a right rear window of said respective pair.

2. A two-sided scoreboard as defined in claim 1 further including circumferential drive means for selectively rotating said front and rear disks of a desired pair of disks about said axial mounts until a desired sequence of scoring symbols is visible through the front window and the pair of rear windows corresponding to said desired pair.

3. A two-sided scoreboard as defined in claim 2 further including boundary and team identification markings on said rear plate for grouping said pairs of spaced apart rear windows to facilitate the viewing and recognition thereof.

4. A two-sided scoreboard as defined in claim 2 wherein said front window comprises a window array of two adjacent windows, one of said symbols of said pair of symbols being viewed through each of said adjacent windows.

5. A two-sided scoreboard as defined in claim 4 further including boundary and team identification markings on said front plate for grouping said window arrays to facilitate the viewing and recognition thereof.

6. A two-sided scoreboard as defined in claim 2 wherein said circumferential drive means comprises a manual force applied tangentially to the circumference of each of said disks.

7. A two-sided scoreboard as defined in claim 2 wherein said sets of scoring symbols comprise the set of arabic numerals 0, 1, 2, 3, 4, 5, 6, 7, 8, and 9.

8. A two-sided scoreboard as defined in claim 7 wherein said set of arabic numerals is uniformly spaced around the circumference of both sides of each disk in numerical order.

9. A two-sided scoreboard as defined in claim 8 wherein said set of arabic numerals on one side of each disk is phased approximately 90° with respect to said set of arabic numerals on the other side of the same disk.

10. A two-sided scoreboard as defined in claim 1 wherein said front disk of each pair of disks comprises:

(a) a transparent disk having a radius r; and (b) a first flat thin opaque ring having an inside radius of approximately r/2 and an outside radius approximately equal to r affixed to one side of said transparent disk, one of said sets of scoring symbols being affixed to the outside of said first opaque ring.

11. A two-sided scoreboard as defined in claim 10 wherein said front disk further comprises a second flat thin opaque ring having an inside radius no less than r/2, and an outside radius approximately equal to r, said second opaque ring being affixed to the other side of said transparent disk and the other of said sets of scoring symbols being affixed to the outside of said second opaque ring.

12. A two-sided scoreboard as defined in claim 1 wherein said front and rear disks of each pair of disks are interchangeable.

* * * * *